United States Patent [19]

Kohama et al.

[11] Patent Number: 4,489,695

[45] Date of Patent: Dec. 25, 1984

[54] METHOD AND SYSTEM FOR OUTPUT CONTROL OF INTERNAL COMBUSTION ENGINE

[75] Inventors: Tokio Kohama, Nishio; Seizi Huzino; Hideki Obayashi, both of Okazaki; Hisasi Kawai, Toyohashi; Tsuneyuki Egami, Aichi, all of Japan

[73] Assignee: Nippon Soken, Inc., Nishio, Japan

[21] Appl. No.: 343,365

[22] Filed: Jan. 27, 1982

[30] Foreign Application Priority Data

Feb. 4, 1981 [JP] Japan ..... 56-15360

[51] Int. Cl.[3] ..... F02D 17/00

[52] U.S. Cl. ..... 123/481; 123/198 F

[58] Field of Search ..... 123/481, 198 F, 486

[56] References Cited

U.S. PATENT DOCUMENTS

| | | | |
|---|---|---|---|
| 3,756,205 | 9/1973 | Frost | 123/481 |
| 4,040,395 | 8/1977 | Demetrescu | 123/198 F |
| 4,103,655 | 8/1978 | Coles | 123/481 |
| 4,129,109 | 12/1978 | Matsumoto | 123/481 |
| 4,144,864 | 3/1979 | Kato et al. | 123/481 |
| 4,146,006 | 3/1979 | Garabedian | 123/198 F |
| 4,165,610 | 8/1979 | Iizuka et al. | 123/481 |
| 4,172,434 | 10/1979 | Coles | 123/198 F |
| 4,188,922 | 2/1980 | Aoki | 123/481 |
| 4,335,687 | 6/1982 | Sugasawa | 123/198 F |

*Primary Examiner*—Ronald B. Cox

*Attorney, Agent, or Firm*—Cushman, Darby & Cushman

[57] ABSTRACT

The number of working cylinders of the internal combustion engine is controlled so that the load of the internal combustion engine is relatively increased thereby to keep the combustion effect within an expected range. By controlling the number of working cylinders of the internal combustion engine also to other than integral numbers, the torque control of large freedom is continuously effected. Thus the torque characteristic is smoothed, thus improving the fuel efficiency and driveability at the same time.

6 Claims, 12 Drawing Figures

FIG. 12

NUMBER OF WORKING CYLINDERS = 6.00

| | ADDRESS | CYLINDER No. 1 | 5 | 3 | 6 | 2 | 4 |
|---|---|---|---|---|---|---|---|
| 1 | 1920 | H | H | H | H | H | H |
| 2 | 1921 | H | H | H | H | H | H |
| 3 | 1922 | H | H | H | H | H | H |
| 4 | 1923 | H | H | H | H | H | H |
| 5 | 1924 | H | H | H | H | H | H |
| 6 | 1925 | H | H | H | H | H | H |
| 7 | 1926 | H | H | H | H | H | H |
| 8 | 1927 | H | H | H | H | H | H |
| 9 | 1928 | H | H | H | H | H | H |
| 10 | 1929 | H | H | H | H | H | H |
| 11 | 1930 | H | H | H | H | H | H |
| 12 | 1931 | H | H | H | H | H | H |
| 13 | 1932 | H | H | H | H | H | H |
| 14 | 1933 | H | H | H | H | H | H |
| 15 | 1934 | H | H | H | H | H | H |
| 16 | 1935 | H | H | H | H | H | H |
| 17 | 1936 | H | H | H | H | H | H |
| 18 | 1937 | H | H | H | H | H | H |
| 19 | 1938 | H | H | H | H | H | H |
| 20 | 1939 | H | H | H | H | H | H |

$Q_0$ $Q_1$ $Q_2$ $Q_3$ $Q_4$ $Q_5$

CYLINDER SELECTION DATA Sc

NUMBER OF WORKING CYLINDERS = 5.80

| ADDRESS | CYLINDER No. 1 | 5 | 3 | 6 | 2 | 4 |
|---|---|---|---|---|---|---|
| 1792 | L | H | H | H | H | H |
| 1793 | H | H | H | H | H | H |
| 1794 | H | H | H | H | H | H |
| 1795 | H | H | H | H | H | H |
| 1796 | H | H | H | H | H | H |
| 1797 | L | H | H | H | H | H |
| 1798 | H | H | H | H | H | H |
| 1799 | H | H | H | H | H | H |
| 1800 | H | H | H | H | H | H |
| 1801 | H | H | H | H | H | H |
| 1802 | L | H | H | H | H | H |
| 1803 | H | H | H | H | H | H |
| 1804 | H | H | H | H | H | H |
| 1805 | H | H | H | H | H | H |
| 1806 | H | H | H | H | H | H |
| 1807 | L | H | H | H | H | H |
| 1808 | H | H | H | H | H | H |
| 1809 | H | H | H | H | H | H |
| 1810 | H | H | H | H | H | H |
| 1811 | H | H | H | H | H | H |

NUMBER OF WORKING CYLINDERS = 4.50

| ADDRESS | CYLINDER No. 1 | 5 | 3 | 6 | 2 | 4 |
|---|---|---|---|---|---|---|
| 960 | L | H | H | H | L | H |
| 961 | H | H | L | H | H | H |
| 962 | L | H | H | H | L | H |
| 963 | H | H | L | H | H | H |
| 964 | L | H | H | H | L | H |
| 965 | H | H | L | H | H | H |
| 966 | L | H | H | H | L | H |
| 967 | H | H | L | H | H | H |
| 968 | L | H | H | H | L | H |
| 969 | H | H | L | H | H | H |
| 970 | L | H | H | H | L | H |
| 971 | H | H | L | H | H | H |
| 972 | L | H | H | H | L | H |
| 973 | H | H | L | H | H | H |
| 974 | L | H | H | H | L | H |
| 975 | H | H | L | H | H | H |
| 976 | L | H | H | H | L | H |
| 977 | H | H | L | H | H | H |
| 978 | L | H | H | H | L | H |
| 979 | H | H | L | H | H | H |

NUMBER OF WORKING CYLINDERS = 3.00

| ADDRESS | CYLINDER No. 1 | 5 | 3 | 6 | 2 | 4 |
|---|---|---|---|---|---|---|
| 0 | L | H | L | H | L | H |
| 1 | L | H | L | H | L | H |
| 2 | L | H | L | H | L | H |
| 3 | L | H | L | H | L | H |
| 4 | L | H | L | H | L | H |
| 5 | L | H | L | H | L | H |
| 6 | L | H | L | H | L | H |
| 7 | L | H | L | H | L | H |
| 8 | L | H | L | H | L | H |
| 9 | L | H | L | H | L | H |
| 10 | L | H | L | H | L | H |
| 11 | L | H | L | H | L | H |
| 12 | L | H | L | H | L | H |
| 13 | L | H | L | H | L | H |
| 14 | L | H | L | H | L | H |
| 15 | L | H | L | H | L | H |
| 16 | L | H | L | H | L | H |
| 17 | L | H | L | H | L | H |
| 18 | L | H | L | H | L | H |
| 19 | L | H | L | H | L | H |

H: WORKING L: SUSPENDED

METHOD AND SYSTEM FOR OUTPUT CONTROL OF INTERNAL COMBUSTION ENGINE

BACKGROUND OF THE INVENTION

The present invention relates to method and system of output control for multicylinder internal combustion engines, in which under partial load of the engine, fuel is supplied to some cylinders intermittently for intermittent cylinder operation, and all the cylinders are operated for acceleration at the time of the intermittent cylinder operation.

DESCRIPTION OF THE PRIOR ART

For facilitating the understanding of the present invention, the prior art will be described.

FIG. 1 is a graph showing the relation between the intake pipe pressure, fuel consumption rate and the torque. In FIG. 1, it is seen that when the internal combustion engine is operated under high load, the fuel consumption rate tends to increase.

In FIG. 1, when an internal combustion engine is operated at high load, the fuel consumption rate tends to improve. In view of this, a number-of-cylinders control system is well known in which at a small load, fuel supply to a portion of the multiple cylinders is stopped thereby to suspend the operation thereof, while increasing the load on the other working cylinders relatively, so that the fuel efficiency of the internal combustion engine as a whole is improved.

In the case where a 6-cylinder engine is run with only three cylinders thereof working under a small load as shown in FIG. 1, for instance, the engine can be operated with low fuel consumption as point Ⓐ changes to Ⓑ at the engine speed of 1000 rpm and from Ⓒ to Ⓓ at the engine speed of 2000 rpm.

In conventional systems involving a 6-cylinder engine, a partial cylinder operation concerns merely an integral number of cylinders such as 4 or 3 cylinders, thus narrowing the freedom of control. Further, in the conventional systems, smooth transfer is difficult at transient points from 6-cylinder operation to 4-cylinder operation or to 3-cylinder operation or from any of the latter to the former.

FIG. 2 shows a diagram showing the relation between the number of working cylinders and torque for explaining the present invention.

As shown in FIG. 2, in the case 6-cylinder engine, the relation between the number of working cylinders and torque is linear. (In conventional output control systems for internal combustion engines, an integral number of cylinders is involved such as 3, 4 or 6 cylinders).

In the case where the 6-cylinder engine is operated with only three cylinders thereof working, the conventional control systems are such that as shown in FIG. 1, the fuel consumption changes from Ⓐ to Ⓑ, while the fuel consumption changes from Ⓐ to Ⓑ, in the case of only four cylinders working. This shows a considerable difference in the result of partial engine operation depending on the number of working cylinders involved.

In running an internal combusiton engine, the ultimate aim is to secure a certain degree of torque. When an excessive torque is produced by the three-cylinder operation, therefore, the engine is driven at point Ⓑ″ by closing the throttle valve in a manner to reduce the load. In the case of six-cylinder operation, the engine is driven at point Ⓐ′. When compared with the operation at Ⓑ, the effect is larger at Ⓑ″ than at Ⓐ′ for the three-cylinder operation although the difference is not significant.

SUMMARY OF THE INVENTION

An object of the present invention is to provide an output control system in which the number of working cylinders of the internal combustion engine is controlled to increase the load relatively in such a manner that the combustion effect is kept always within an expected range thereby to improve the fuel consumption rate of the internal combustion engine.

Another object of the present invention is to provide an output control system in which the number of working cylinders may be controlled to 5.5, 5.75 or other numbers than integral numbers thereby to permit torque control of large freedom on the one hand and the torque is controlled continuously by control of the number of working cylinders to other than the integral numbers on the other hand, so that the torque characteristic is smoothed thereby to improve the drivability.

A further object of the present invention is to provide an output control system in which the acceleration of the internal combustion engine is detected and all the cylinders are operated at the time of acceleration thereby to obviate the torque shortage.

BRIEF DESCRIPTION OF THE DRAWINGS

FIG. 12 is a diagram showing an example of the data stored in the memory circuit provided in the number-of-cylinders control circuit of FIG. 8.

DESCRIPTION OF THE PREFERRED EMBODIMENTS

An output control system for the internal combustion engine according to the present invention will be described below with reference to embodiments.

Figure 3:
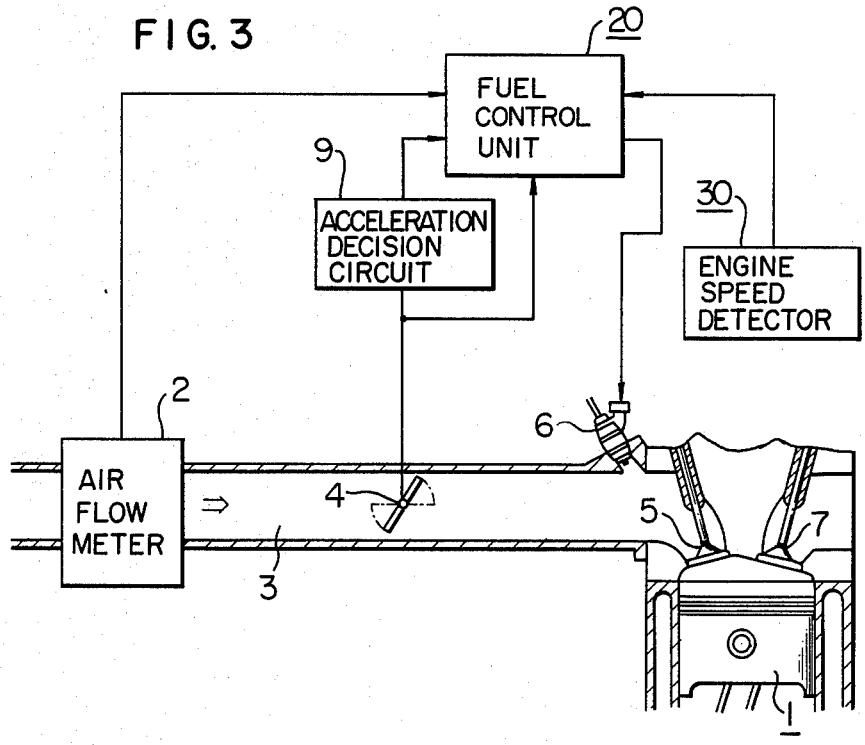
FIG. 3 is a diagram showing a construction of an embodiment of the output control system for internal combustion engines according to the present invention.
Figure 4:
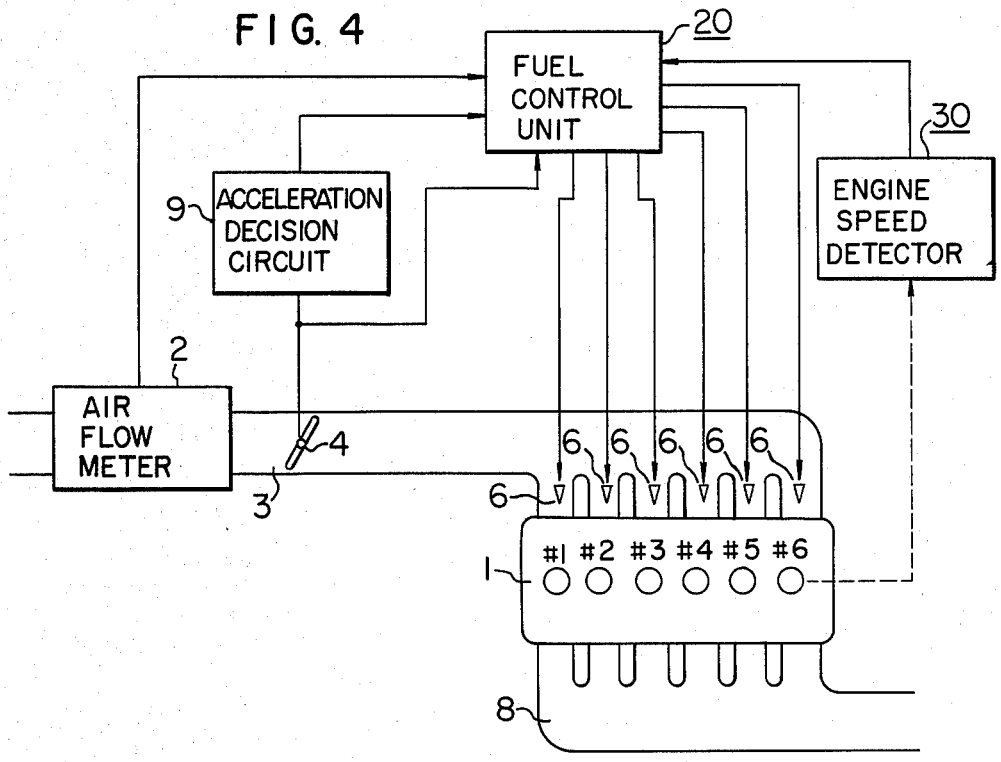
FIG. 4 is a diagram related to FIG. 3 showing an output control system for the internal combustion engine according to the present invention.
Figure 5:
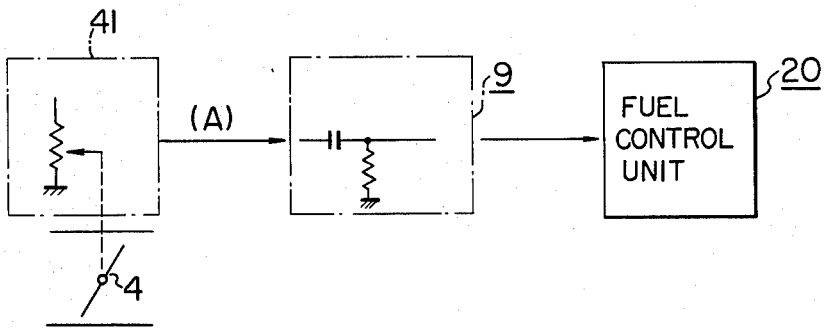
FIG. 5 is a diagram showing a construction of the fuel control unit in FIG. 4.

FIG. 3 is a diagram showing the construction of an embodiment of the output control system for the internal combustion engine according to the present invention, FIG. 4 is a diagram related to FIG. 3, and FIG. 5 shows a construction of the fuel control unit in FIG. 4.

In FIG. 3, the internal combustion engine 1 is of spark ignition type for driving the automobile and is adapted to be supplied with the air for combustion through an air cleaner not shown, an air flowmeter 2, an intake pipe 3, a throttle valve 4 and an intake valve 5. The opening signal of the throttle valve 4 is used as output signal means. According to the present embodiment, the means for producing the opening signal is made up of the output of the potentiometer 41 provided on the throttle valve 4 as shown in FIG. 5. The fuel is supplied by injection from an electromagnetic fuel injector 6 mounted on the intake pipe 3. As shown in FIG. 4, the electromagnetic fuel injector 6 is mounted on each of the cylinders. As shown in FIG. 3, the intake pipe 3 is provided with the throttle valve 4 operated as desired by the vehicle driver. The air-fuel mixture combusted in the internal combustion engine 1 is discharged into the atmosphere as exhaust gas through the exhaust valve 7 and an exhaust pipe 8.

Numeral 30 designates an engine speed detector for detecting the engine speed of the engine 1, which engine speed detector uses an ignition signal for the ignition coil according to the present embodiment. Numeral 9 designates an acceleration decision circuit supplied with an opening signal of the throttle valve 4 (an output signal of the potentiometer 41), which determines an acceleration value corresponding to the opening degree and produces it to the fuel control unit 20 for a predetermined period of time. The fuel control unit 20 is impressed with an output signal of the air flow meter 2, an opening signal of the throttle valve 4, a detection signal of the engine speed sensor 30 and the differentiated value of the opening signal of the throttle valve 4. In accordance with these signals, the opening operation and the opening time of the electromagnetic fuel injection valves are controlled.

Figure 7:
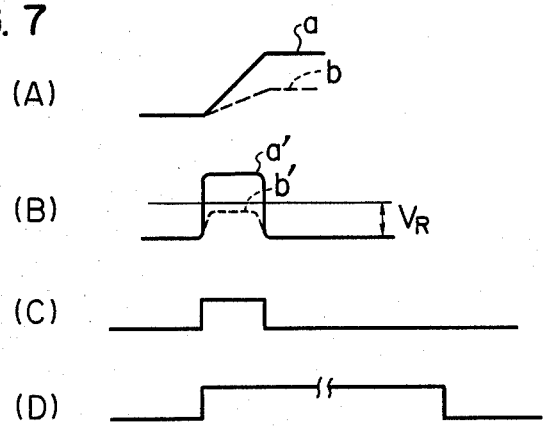
FIG. 7 is a diagram for explaining the operation of the acceleration decision circuit shown in FIG. 6.
Figure 6:
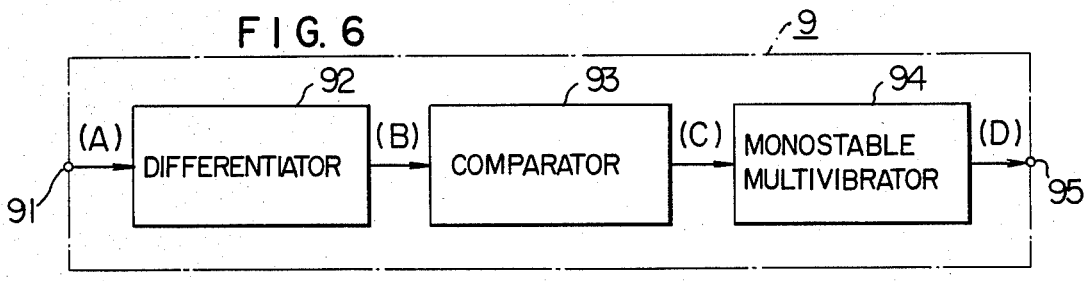
FIG. 6 is a diagram showing a construction of the acceleration decision circuit shown in FIG. 5.

FIG. 6 is a diagram showing the construction of the acceleration decision circuit 9 shown in FIG. 5, and FIG. 7 a diagram for explaining the operation of the acceleration decision circuit 9 shown in FIG. 6.

In FIG. 6, numeral 91 designates an input terminal connected to the output terminal of the potentiometer 41. Numeral 92 designates a well-known differentiator circuit the input terminal of which is connected to the input terminal 91 of the acceleration decision circuit 9, the output terminal of a differentiator circuit 92 being connected to a comparator 93. The comparator 93 is a well-known circuit the output terminal of which is connected to the input terminal of the monostable multivibrator 94. The monostable multivibrator 94 is a well-known circuit the output terminal of which is connected to an output terminal 95 of the acceleration decision circuit 9. The operation of the acceleration decision circuit 9 will be described with reference to FIG. 7. When the acceleration pedal not shown in the drawing is depressed, the output voltage of the potentiometer 41 operatively interlocked with the throttle changes as shown at (A) of FIG. 7. At (A) of FIG. 7, curve a is associated with the strong depression of the acceleration pedal, while curve b is the output voltage produced when the depression of the acceleration pedal is gentle. In this case, the output as shown at (B) of FIG. 7 is produced from the differentiator circuit 92. The solid line a' denotes the waveform in the case where the voltage of solid line a at (A) of FIG. 7 is differentiated, and dotted line b' denotes the differentiation of the dotted line b at (A) of FIG. 7. The comparator circuit 93 is for comparing the constant voltage $V_R$ at (B) of FIG. 7 with the output voltage (B) of the diferentiator circuit 92, and when the output voltage (B) exceeds the constant voltage $V_R$, produces a high level output as shown in the waveform at (C) of FIG. 7. In other words, when the acceleration pedal not shown is depressed at a rate higher than a predetermined level, an output signal is produced from the comparator 93. When the output of the comparator 93 becomes high in level, the monostable multivibrator 94 is actuated to produce a high-level signal followed by reduction to low level after the lapse of a predetermined length of time. The result is the waveform as shown at (D) of FIG. 7.

The output terminal of the acceleration decision circuit 9 is connected to the fuel control unit 20.

Figure 8:
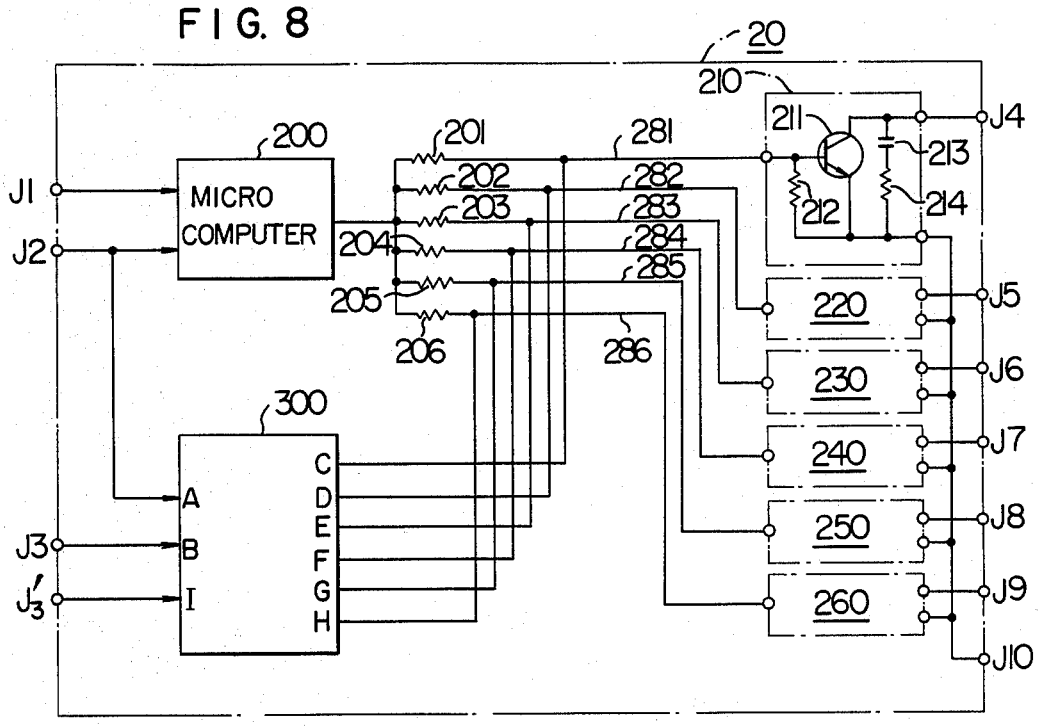
FIG. 8 is a diagram showing the construction of the number-of-cylinders control circuit shown in FIG. 3.
Figure 9:
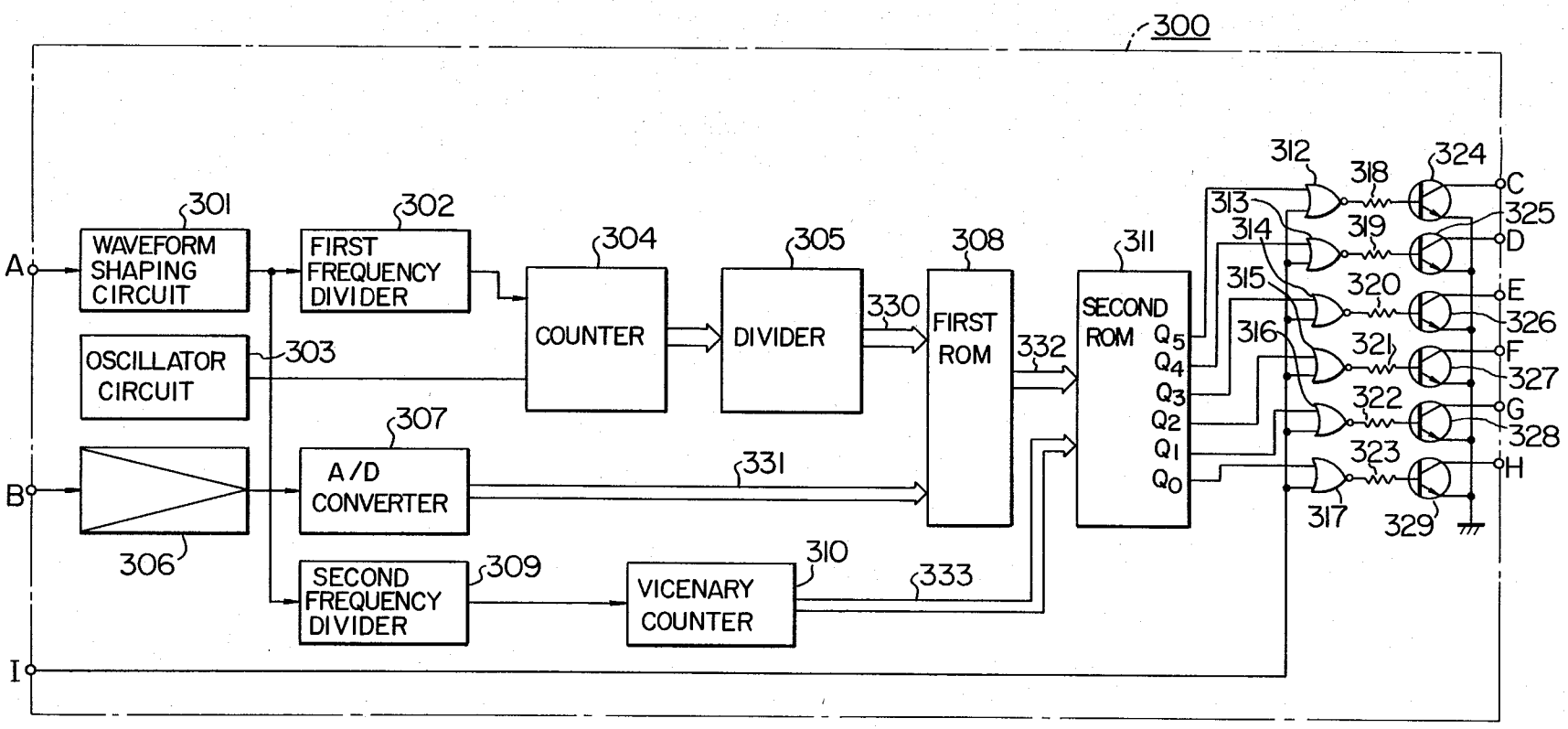
FIG. 9 is a diagram showing the construction of the number-of-cylinders control circuit shown in FIG. 8.

FIG. 8 shows a construction of the fuel control unit 20 shown in FIG. 3, and FIG. 9 shows a construction of the number-of-cylinders control circuit 300 shown in FIG. 8.

The construction of the fuel control unit 20 shown in FIG. 3 will be described with reference to FIGS. 8 and 9.

In FIG. 8, reference numeral 200 designates a well-known micro computer. With an air amount signal and an ignition signal in synchronism with the engine crank rotation applied by way of the terminals $J_1$ and $J_2$ respectively, a valve open signal for the electromagnetic fuel injection valve is produced. Numeral 210 designates a power switch circuit for actuating the injection valve, which switch comprise a power transistor 211, a base-grounded resistor 212, a capacitor 213 and a resistor 214.

Numeral 220, 230, 240, 250 and 260 show power switch circuits of the same circuit configuration as the power switch 210 for independently driving the injector 6 of the engine cylinders in cooperation with the power switch circuit 210.

Resistors 201, 202, 203, 204, 205 and 206, with an end thereof connected in common to the outputs of the micro computer 200 have the other ends thereof connected to the power switch circuits 210, 220, 230, 240, 250 and 260 through the connecting lines 281, 282, . . . , 286 respectively.

In FIG. 9, numeral 300 designates the number-of-cylinders control circuit, which in response to the ignition signal applied to the input terminal A from the terminal $J_2$ in FIG. 8, the throttle opening signal applied to the input terminal B from the terminal $J_3$, and the acceleration signal applied to the input terminal I from the terminal $J_3'$, determines the number of working cylinders thereby to subject to on-off control the connecting lines 281, 282, 283, 284, 285 and 286 by way of the output terminals C, D, E, . . . , H. In this way, each cylinder is actuated or non-actuated for fuel injection thereby to control the number of working cylinders. The terminals $J_4$, $J_5$, $J_6$, $J_7$, $J_8$ and $J_9$ are connected to the injection valves 6 provided in the prespective cylinders. The terminal $J_{10}$ is a power grounding terminal.

Now, a detailed construction of the number-of-cylinders control circuit 300 will be explained with reference to FIG. 9. Numeral 301 designates a well-known waveform shaping circuit for shaping the ignition signal applied to the input terminal A into a pulse signal. Numeral 302 designates a well-knwon first frequency divider circuit for dividing the frequency of the output signal of the waveform shaping circuit 301 and producing a pulse signal with a period corresponding to the time of two revolutions of the crankshaft of the engine.

Numeral 303 designates a well-known oscillator circuit using a crystal oscillator or the like for generating a clock signal of a predetermined frequency. Numeral 304 designates a counting circuit for counting the pulse duration of the first frequency divider circuit 302 by means of the clock signal of the oscillator circuit 303. Numeral 305 designates a well-known divider circuit for producing the reciprocal of the count in the counter circuit 304 thereby to produce a 7-bit binary data on the engine speed. Numeral 306 designates a well-known amplifier circuit using an operational amplifier for amplifying the throttle opening signal of the throttle valve 4 shown in FIGS. 3 and 4 applied from the input terminal B. Numeral 307 designates a well-known analog-digital converter (hereinafter called the A/D converter) for converting the output signal of the amplifier circuit 306 into a digital signal in the form of a 6-bit binary number. Numeral 308 designates a well-known memory circuit which is a first read-only memory (hereinafter referred to as the first ROM) in which an output value is programmed for each input. This memory circuit 308 contains 6 bits for each word and has a total program capacity of 8K words. The first ROM has addresses of 13 bits, for the most significant 7 bits of which the output signal of the divider circuit 307 is connected through the connecting line 330, and the output of the A/D converter 307 is connected by the connecting line 331 for the less significant 6 bits. Numeral 309 designates a well-known second frequency divider circuit for producing a signal of one pulse for each two revolutions of the engine crankshaft by frequency dividing the output signal of the waveform shaping circuit 301. Numeral 310 designates a vicenary counter circuit for continuously counting the output signal of the second frequency divider circuit 309 thereby to produce the count in the form of a 5-bit binary number. Numeral 311 designates a second ROM of the same construction as the first ROM 308. The second ROM 311 comprises 6 bits for word and has a program capacity of 2K words. Each address of this second ROM 311 has 11 bits, of which the most significant 6 bits are such that the output of the first ROM 308 is connected through the connectting line 332, and for the less significant five bits, the output of the vicenary counting circuit 310 is connected through the connecting line 333. Numerals 312, 313, 314, 315, 316 and 317 designate NOR gates, each having one of the input terminals thereof connected to the outputs $Q_5$, $Q_4$, $Q_3$, $Q_2$, $Q_1$ and $Q_0$ of the second ROM 311 in that order. The other input each of the NOR gates 312, 313, 314, 315, 316 and 317 is connected to the input I of the number-of-cylinders control circuit 300. The output of the NOR gate 312 is connected through the resistor 319 to the base of the transistor 325. The output of the NOR gate 314 is connected through the resistor 320 to the base of the transistor 326. The output of the NOR gate 315 is connected through the resistor 321 to the transistor 327. The output of the NOR gate 316 is connected through the resistor 322 to the base of the transistor 328. The output of the NOR gate 317 is connected through the resistor 323 to the base of the transistor 329. The emitters of the transistors 324 to 329 are grounded, and the collectors thereof are connected to the output terminals C, D, . . . , H of the number-of-cylinders control circuit 300.

Figure 10:
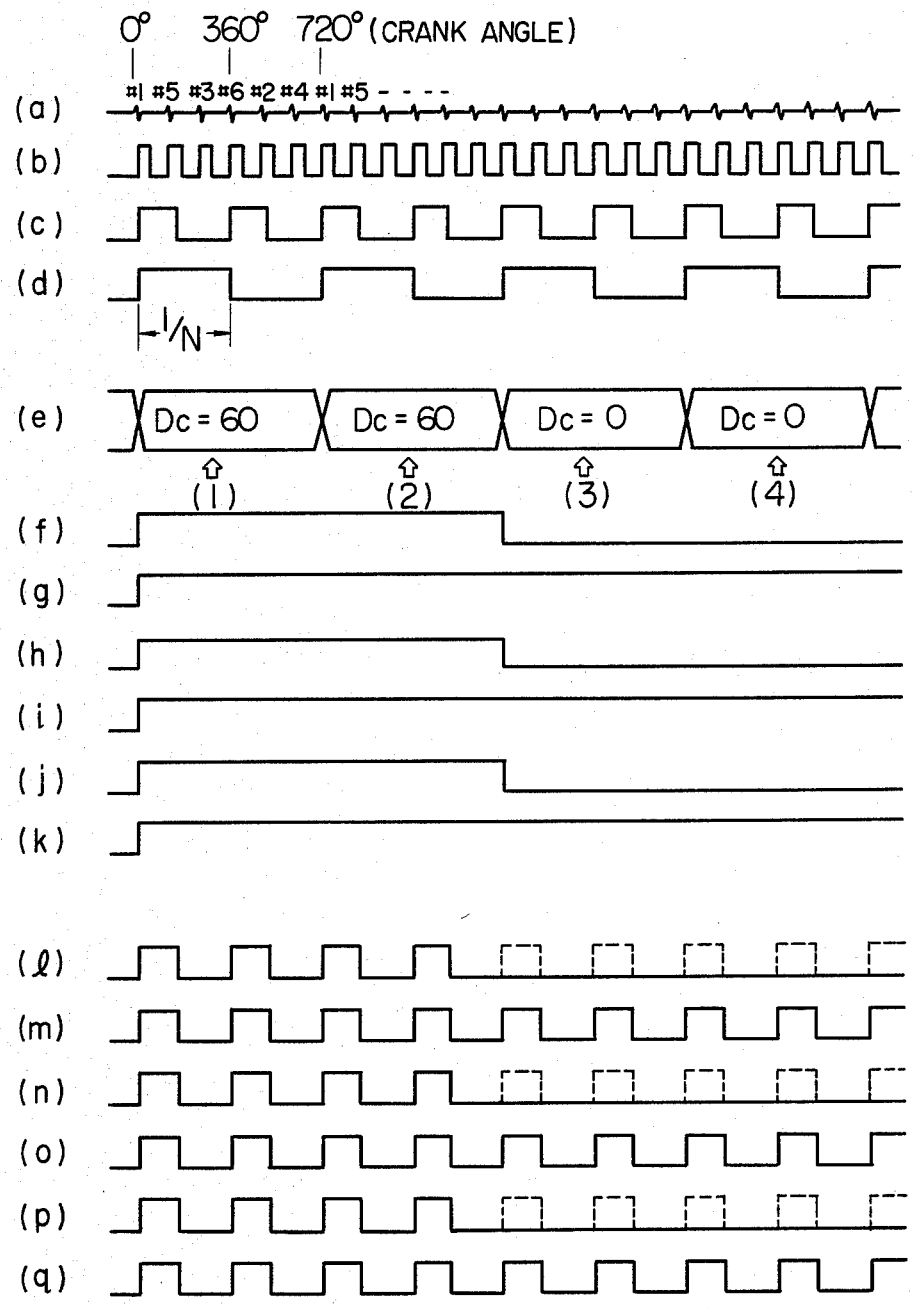
FIG. 10 shows waveforms of operation for the fuel control unit.

FIG. 10 shows waveforms for explaining the operation of the fuel control unit according to the present invention.

The terminals $J_1$ and $J_2$ of the fuel control unit 20 shown in FIG. 8 are supplied with a signal representing the air amount measured at the air flowmeter 2 and an ignition signal detected from the ignition coil. It is well known that the opening signal of the electromagnetic injection valve is calculated by the EFi 200 to produce the signal as shown at (c) of FIG. 10.

The ignition signal applied to the input terminal $J_2$ of the fuel control unit 20, on the other hand, is applied to the input terminal A of the number-of-cylinders control circuit 300. This signal is shaped by the waveform shaping circuit 301 and transformed into the pulse signal as shown at (b) of FIG. 10. This signal is frequency-divided to 1/6 by the frequency divider circuit 302, so that one period of the signal at (d) of FIG. 10 corresponds to the crank angle of 720 degrees and the pulse width is proportional to the reciprocal of the engine speed N. This pulse width is counted at the counter circuit 304 by use of a clock signal of a predetermined frequency produced from the oscillator circuit 303. As a result, the count n of the counter circuit 304 takes the value as shown in the equation below.

$$n = K_1 \cdot \frac{1}{N} \tag{1}$$

($K_1$: constant)

With this count n as a divisor and with the divided as a constant, division is made by the dividing circuit 305, thus producing the result m as expressed by the equation below.

$$m = K_2 \cdot N \tag{2}$$

($K_2$: proportionality constant)

Assume that by appropriately selecting the frequency of the clock signal of the oscillator circuit 303, the proportionality constant $K_2$ of equation (2) is made variable and the output data m of the divider circuit 305 takes a value of 127 (7 bits in binary notation) at the engine speed N of 6000 rpm. The resolution of the output of the divider circuit 305 is about 47 rpm.

The throttle opening signal of the throttle valve 4 applied to the input terminal $J_3$ of the fuel control unit 20 is applied to the number-of-cylinders control circuit 300, and amplified to an appropriate voltage by the amplifier circuit 306. The output of the amplifier circuit 306 is converted into a digital value by the A/D converter 307. By appropriately selecting the gain of the amplifier circuit 306, the converted value TH takes values from 0 to 63 (6 bits in binary number) in decimal number in the throttle opening range from the closed-up state to full-open state. If the A/D conversion is effected every two revolutions of the crankshaft, the calculation of the engine speed is effected at intervals of as many revolutions of the crankshaft. Therefore, the amount determined by the throttle opening TH and the parameter of the engine speed N which is an output of the dividing circuit 305 changes every two revolutions of the crankshaft. If the number of engine working cylinders based on these two parameters is stored in the memory circuit 308, therefore, the output data of the memory circuit 308 undergoes a change every two revolutions of the crankshaft as shown at (e) of FIG. 10.

Figure 11:
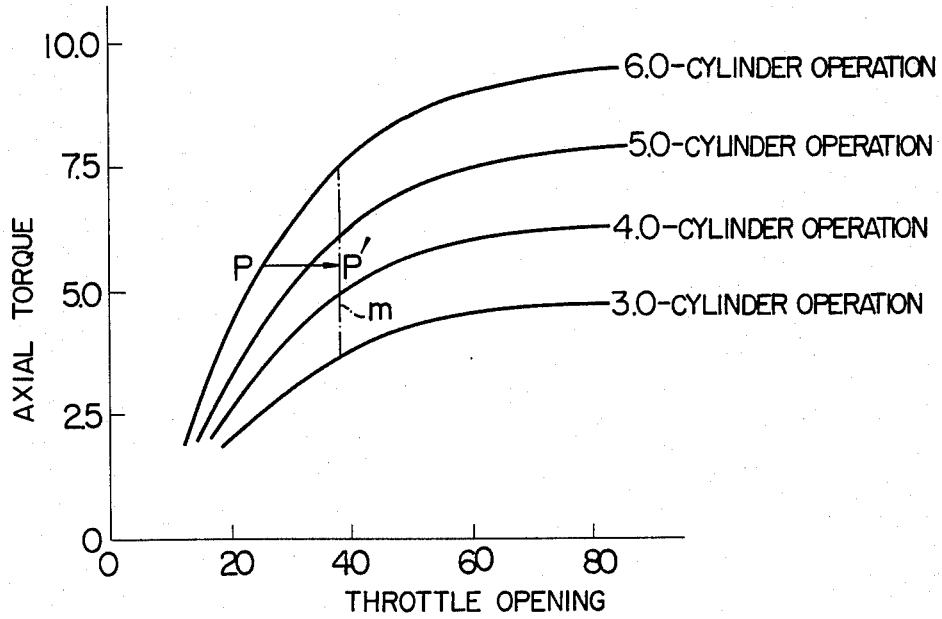
FIG. 11 is a diagram showing the relation between the engine throttle opening and the axial torque.

The data Dc on the number of working cylinders stored in the memory circuit 308 are determined from the characteristics of FIG. 11. FIG. 11 shows a graph of the well-known relation between the throttle opening and the axial torque of the 6-cylinder 2000 cc engine, and specifically refers to the characteristics for the engine speed of 2000 rpm.

In FIG. 11, the abscissa represents the throttle opening in %, and the ordinate represents the axial torque. With the constant engine speed N of 2000 rpm, the parameters involve partial cylinder operation. The intersection between the one-dot chain m and the parameter curve for 6-cylinder operation in FIG. 11 corresponds to point K for the engine speed of 2000 rpm. The one-dot chain m is parallel to the Y axis and makes up a line of equal manifold negative pressure.

When a torque of 5.6 kg.m is required, the point P is reached for the total cylinder operation. The point of optimum fuel efficiency is attained by the cylinder operation at the intersection P' between this torque and the line m. In this case, the number of cylinders is determined to be 4.50 from the proportional distribution based on the curves of 4.00 and 5.00 cylinders. When the operation is changed to this 4.5 cylinder operation, the driver is naturally required to attain the 3.6% throttle opening by depressing the throttle valve further than for the total cylinder operation. As a result, the figure of 4.50 is produced for the engine speed of 2000 rpm and the throttle opening of 36% as a value programmed in the first ROM.

As described above, for each engine speed, a characteristic diagram as shown in FIG. 11 is prepared and the number of working cylinders is programmed in the first ROM 308 in every case. In the case under consideration, the data DC on the number of working cylinders ranges from 3 to 6, and the resolution is set to 0.05 cylinders. Then $3 \div 0.05 = 60$, which shows that 6 bits is required in binary number. The value programmed in the first ROM 308 is $(4.50-3) \div 0.05 = 30$ which is "011110" in binary number.

Generally, the value Dc is determined from the equation below.

$$Dc = (\text{Number of working cylinders} - 3) \div 0.05 \quad (3)$$

Now, explanation will be made of the cylinder selection data Sc to be programmed in the second ROM 311. The cylinder selection data Sc is comprised of 6 bits for each work, each of the bits $Q_0$ to $Q_5$ corresponding to the cylinders in the number of 1, 5, 3, 6, 2 and 4 of the engine respectively as shown in FIG. 9. The cylinder selection data Sc are comprised of 20 addresses dependent solely on the number of working cylinders.

FIG. 12 is a chart showing an example of the data for the memory circuit provided in the number-ofcylinders control circuit shown in FIG. 8. This drawing especially shows the case in which 6.00, 5.80, 4.50 and 3.00 working cylinders are involved.

If the number of working cylinders is 5.8, for instance, in the address range from 1792 to 1811, each address corresponds to two revolutions of the engine, so that 20 addresses correspond to 40 revolutions of the crankshaft. If 6 cylinders are worked for 2 revolutions of the crankshaft, 40 revolutions of the crankshaft correspond to 120 cylinders working and therefore the number of working cylinders is 5.80. From the equation $(120-x)/120 = 5.80/6.00$, the number of suspensions during the working equivalent to 120 cylinders x is determined to be 4. In the case of 5.8 working cylinders in FIG. 12, the first cylinder of the addresses 1792, 1797, 1802 and 1807 is idle.

It will be easily understood that the relation between the number of working cylinders and the number of suspensions during 40 revolutions of crankshaft is as shown below.

$$\text{Number of working cylinders} = \frac{120 - \text{Number of suspensions}}{120} \times 6.00 \quad (4)$$

From the relation of equation (4), the number of suspensions for the number of working cylinders of 4.50 at the other addresses in FIG. 12 is 30, so that the cylinder selection data Sc for determining the working or suspension are as shown in FIG. 12. The cylinder selection data Sc for other numbers of working cylinders may be determined in similar manner. These cylinder selection data Sc are stored in the second ROM 311 in advance.

As to the address of the second ROM 311, the significant 6 bits are the output of the first ROM 308, while the less significant 5 bits are the output of the vicenary counter circuit 310 incrementing the count by one for each two revolutions of the crankshaft. Therefore, the output of the first ROM makes up the address of the significant 6 bits of the second ROM. In other words, if the count of the vicenary counter circuit 310 is zero for the number of working cylinders of 6, the number of addresses of the second ROM 311 is $60 \times 32 + 0 = 1920$, so that the output of the second ROM 311 is "HHHHHH".

If the count of the vicenary counter circuit 310 increases one by one, on the other hand, the addresses of the second ROM 311 become 1921, and the output of the second ROM 311 becomes "HHHHHH" representing the full cylinder operation (6 working cylinders). At each two revolutions of the crankshaft, the vicenary counter circuit 310 increases one by one sequentially, and when it counts 20, the count becomes zero twice. Therefore, the number of addresses of FIG. 12 changes from 1920 to 1921 to . . . to 1939 to 1920 and so on thereby to repeat the 6-cylinder operation.

When the output of the acceleration decision circuit 9 is at low level, the output of the second ROM 311 is reversed by the NOR gates 312, 313, . . . , 317 respectively thereby to turn on and off the transistors 324, 325, . . . , 329 through the resistors 318, 319, . . . , 323 respectively. When the output of the second ROM 311 is at "H", the transistor corresponding thereto is turned off thereby to actuate the electromagnetic valve of the cylinder corresponding thereto. By contrast, when the output of the second ROM 311 is low in level, the electromagnetic valve for the cylinder corresponding thereto is stopped. Thus the waveforms shown at (f), (g), . . . , (k) of FIG. 10 correspond to the outputs $Q_0$ to $Q_5$ of the second ROM 311, so that the logic product of this signal and the output signal of the EFi 200 shown at (c) of FIG. 10 may be used to determine injection or non-injection, at (1), (m), . . . , (q) of FIG. 10 representing injection signals for 1, 5, 3, 6, 2 and 4 cylinders respectively. Especially in FIG. 10, the injection waveforms (1) and (2) of (e) represent the 6-cylinder operation, and injection waveforms (3) and (4) the 3-cylinder operation.

In the case where the output of the acceleration decision circuit 9 is high in level, on the other hand, the outputs of the NOR gates 312, 313, . . . , 317 shown in FIG. 9 unconditionally become low in level so that the transistors 324, 325, . . . , 329 are turned off thereby to operate all the cylinders.

The aforementioned embodiment is the case involving an engine of 6 cylinders and 2000 cc. The number of bits for one word in the second ROM 311 may apply also to another multicylinder engine including 4, 8 cylinders or the like.

Although the resolution of 0.05 is employed in the above-mentioned embodiment, the number of bits for each word in the first ROM 308 may be increased to improve the resolution for an improved accuracy as desired.

Further, another combination of the cylinder selection data Sc may be employed as far as the equation (4) is satisfied.

As explained above, if the control point K in FIG. 1 is located at an excessively high load, the torque generated during one combustion cycle increases excessively thereby to cause a surge at the time of control of the number of cylinders. According to the present invention, the number of working cylinders is controlled thereby to relatively increase the load of the internal combustion engine in order for the control point K of FIG. 1 to include the load, thus improving the fuel efficiency.

Further, the number of working cylinders is controlled also to other than integral numbers, so that the continuous torque control is made possible for a smoothed torque characteristic.

Figure 1:
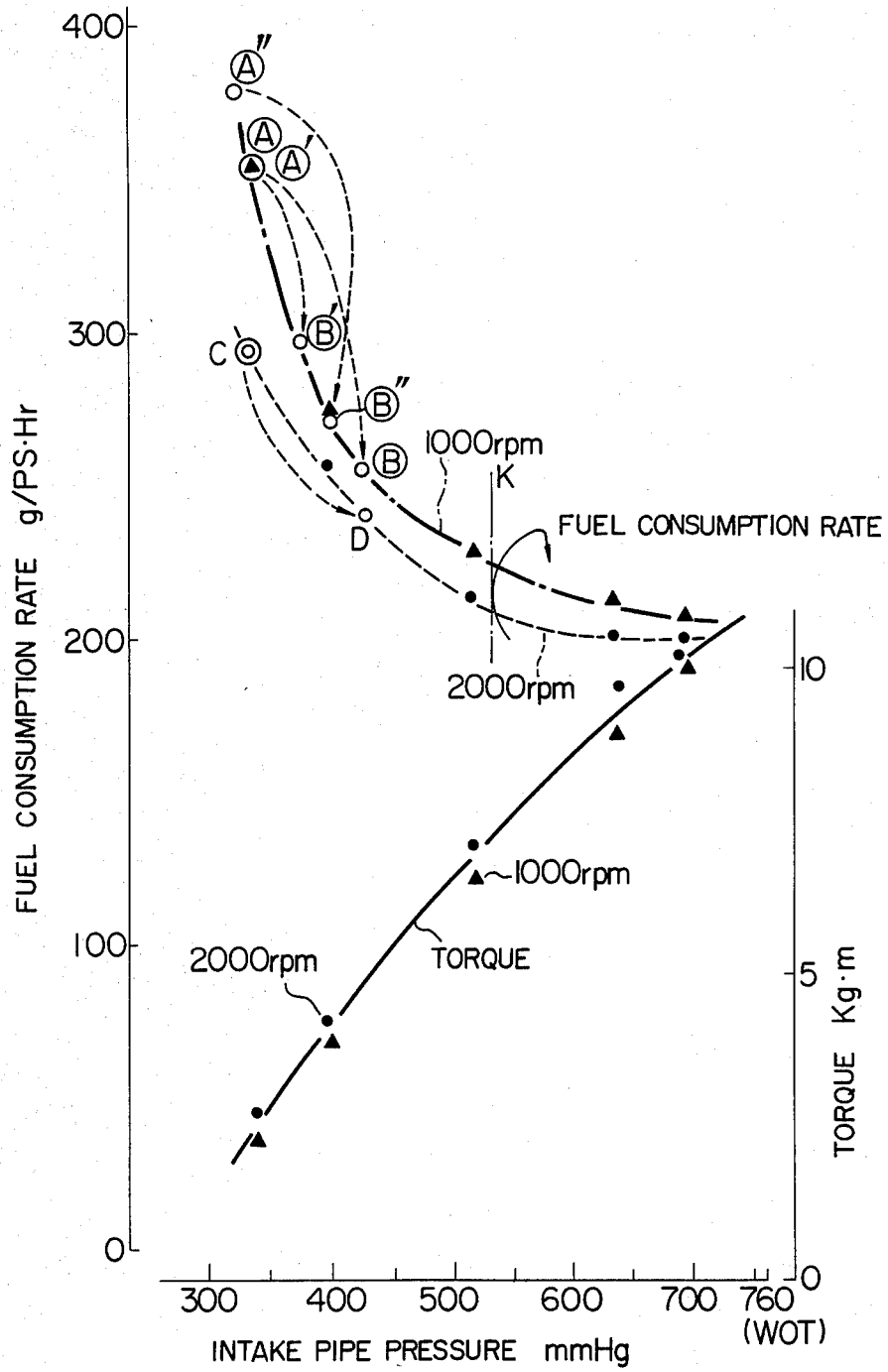
FIG. 1 is a graph showing the relation between the intake pipe pressure and the fuel consumption rate for explaining the present invention.
Figure 2:
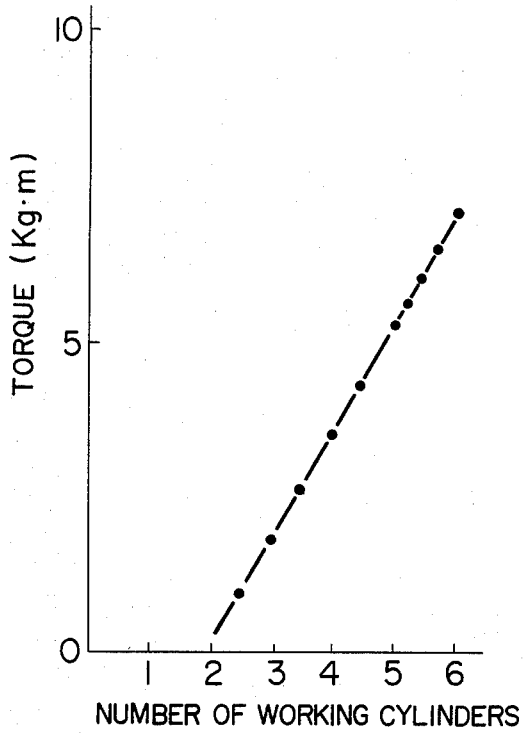
FIG. 2 is a graph showing the relation between the number of working cylinders and the torque.

Furthermore, the number of working cylinders is controlled to increase the apparent load as shown in FIG. 1 and the point A is transferred to the point K. As a result, the torque shortage which otherwise might occur by the operation of partial cylinders at the time of acceleration is eliminated by the present invention in which the acceleration is detected and the full-cylinders operation is performed at the time of acceleration.

We claim:

1. A system for controlling the output of a multicylinder internal combustion engine comprising:

an intake pipe for introducing air for combustion into said internal combustion engine;

fuel supplying means for supplying fuel to said engine;

an engine speed detector for detecting the rotational speed of said engine;

signal output means for producing an output signal corresponding to a required output of said engine and an acceleration signal corresponding to the acceleration of said engine; and a control circuit, responsive to said detector and said signal output means, for: (1) deciding an operating condition of said internal combustion engine on the basis of the output signal from said engine speed detector and said output signal, (2) calculating and storing an optimum negative pressure of said intake pipe for said operating condition, (3) interrupting the fuel supply to at least one of said cylinders in said combustion engine to make said at least one cylinder intermittently operate thereby controlling said engine to produce a torque with said optimum negative pressure of said intake pipe being reached, and (4) disabling said interrupting function upon acceleration so that all the cylinders of said engine can operate.

2. A system according to claim 1, wherein said signal output means includes means for detecting the opening position of a selected one of a throttle valve of said engine and a control valve operatively associated with said throttle valve of said engine.

3. A system according to claim 1, wherein said signal output means differentiates said output signal to generate said acceleration signal.

4. A system according to claim 1, wherein said control circuit determines the number of working cylinders, N, from the relation:

$$N = \frac{120 - C}{120} \times 6.00$$

where C is the number of times that a cylinder stops during 40 rotations of a crankshaft.

5. A system according to claim 1, wherein said control circuit includes a fuel control unit having a microcomputer for computing the amount of fuel to be supplied to each cylinder of said engine on the basis of the data stored in advance related to the output of said engine speed detector.

6. A system according to claim 5, wherein said fuel control unit includes an electrically controlled fuel injection unit responsive to an injection signal for producing a signal for opening an injection valve, a power switch circuit for driving said injection valve and a number-of-cylinders control circuit for controlling whether or not fuel is to be injected in each cylinder to thereby control the number of working cylinders.

* * * * *